US010759509B2

(12) United States Patent
Ash et al.

(10) Patent No.: US 10,759,509 B2
(45) Date of Patent: Sep. 1, 2020

(54) UNMANNED UNDERWATER VEHICLE AND METHOD FOR CONTROLLING HYDRAULIC SYSTEM

(71) Applicant: Fugro N.V., Leidschendam (NL)

(72) Inventors: Benjamin Jeremy Ash, Leidschendam (NL); Alan Neill Anderson, Leidschendam (NL)

(73) Assignee: FUGRO N.V. (NL)

( * ) Notice: Subject to any disclaimer, the term of this patent is extended or adjusted under 35 U.S.C. 154(b) by 0 days.

(21) Appl. No.: 16/315,516

(22) PCT Filed: Jul. 3, 2017

(86) PCT No.: PCT/NL2017/050438
§ 371 (c)(1),
(2) Date: Jan. 4, 2019

(87) PCT Pub. No.: WO2018/009057
PCT Pub. Date: Jan. 11, 2018

(65) Prior Publication Data

US 2019/0210704 A1 Jul. 11, 2019

(30) Foreign Application Priority Data

Jul. 5, 2016 (NL) ..... 2017106

(51) Int. Cl.
*B63C 11/52* (2006.01)
*B63G 8/00* (2006.01)
*F15B 21/042* (2019.01)

(52) U.S. Cl.
CPC ..... *B63G 8/001* (2013.01); *B63C 11/52* (2013.01); *B63G 8/00* (2013.01); *F15B 21/042* (2013.01);
(Continued)

(58) Field of Classification Search
CPC ..... B63G 8/001; B63G 8/00; B63C 11/52; F15B 21/042
See application file for complete search history.

(56) References Cited

U.S. PATENT DOCUMENTS 3,381,485 A 5/1968 Crooks et al.
7,030,616 B1 * 4/2006 Boland, II ..... H01S 5/50 324/329

FOREIGN PATENT DOCUMENTS

DE 4135016 A1 4/1993
DE 4439454 A1 5/1996
(Continued)

OTHER PUBLICATIONS

International Search Report and Written Opinion; PCT Application No. PCT/NL2017/050438; dated Oct. 9, 2017.
(Continued)

*Primary Examiner* — Stephen P Avila
(74) *Attorney, Agent, or Firm* — Polsinelli PC

(57) ABSTRACT

An unmanned underwater vehicle (UUV) with a hydraulic system (100) for use in cold surroundings and method of controlling such hydraulic system. The hydraulic system (100) comprises a hydraulic circuit (10). One or more tools (21,22) may be hydraulically operable via the hydraulic circuit (10). A pump (32) is configured to pressurize a flow of hydraulic fluid (F) via the hydraulic circuit (10) e.g. for actuating the tools (21,22). A valve system (40) comprises control valves (41,42,43) disposed in the hydraulic circuit (10) for controlling the flow of hydraulic fluid (F) through the hydraulic circuit (10). A controller (50) is configured to control one or more of the control valves (43) as a function of a temperature (T) of the hydraulic fluid (F).

20 Claims, 2 Drawing Sheets

(52) U.S. Cl.
CPC ..... *B63G 2008/002* (2013.01); *F15B 2211/40515* (2013.01); *F15B 2211/611* (2013.01); *F15B 2211/6343* (2013.01)

(56) References Cited

FOREIGN PATENT DOCUMENTS

| | | | |
|---|---|---|---|
| EP | 0964166 | A2 | 12/1999 |
| WO | 2018009057 | A1 | 1/2018 |

OTHER PUBLICATIONS

English abstract of DE4135016; retrieved from www.espacenet.com on Jan. 3, 2019.
English abstract of DE4439454; retrieved from www.espacenet.com on Jan. 3, 2019.

* cited by examiner

UNMANNED UNDERWATER VEHICLE AND METHOD FOR CONTROLLING HYDRAULIC SYSTEM

CROSS-REFERENCE TO RELATED APPLICATIONS

This application is a national stage application of International Application No. PCT/NL2017/050438, which was filed on Jul. 3, 2017, which claims priority to Netherlands Application Number 2017106 filed on Jul. 5, 2016, of which is incorporated by reference in its entirety.

TECHNICAL FIELD AND BACKGROUND

The present disclosure relates to an unmanned underwater vehicle for deep water conditions. The disclosure also relates to a method of controlling a hydraulic system in such a vehicle.

A hydraulic system uses a pressurized hydraulic fluid, e.g. oil, to power hydraulic tools. The hydraulic system typically comprises a hydraulic pump driven by a motor to pressurize the hydraulic fluid. The pressurized fluid is guided via a hydraulic circuit to the tools. The hydraulic circuit may comprise valves, filters, piping etcetera to guide and control the system. A hydraulic tool may comprise an actuator such as a hydraulic motor or cylinder to actuate, i.e. mechanically drive, the machinery. Mechanical operation of the tools can be controlled e.g. by opening or closing hydraulic valves in the circuit between the pump and the tool.

Hydraulic systems can be advantageously used under water because power can be conveniently transmitted without electrical connections. However, when operating in deep water conditions, the hydraulic fluid may be affected by cold surroundings and/or high pressure of the water. In particular, when the hydraulic fluid cools down, the fluid may become thick and difficult to move through the hydraulic circuit, especially if the fluid has become stagnant when a tool is not used for some time.

One solution to alleviate thickening at cold surroundings is to replace the hydraulic fluid for fluid having lower viscosity. However, using low viscosity oil may affect operation at relatively high temperature conditions. Another solution for alleviating thickening may be to heat the fluid. However, the heating mechanisms available underwater such as, e.g., electrical heating under water may consume too much power and could present failures, such as short circuits.

Accordingly, it is desired to improve hydraulic systems and their operation for use in cold surroundings, in particular in an unmanned underwater vehicle for deep water conditions.

SUMMARY

According to one aspect, the present disclosure provides an unmanned underwater vehicle with a hydraulic system for use in cold surroundings. The hydraulic system comprises a hydraulic circuit. The circuit may be used e.g. for hydraulically operating the vehicle and/or one or more tools. The system comprises a pump configured to pressurize a flow of hydraulic fluid via the hydraulic circuit e.g. for actuating the vehicle and/or tools. A valve system comprises control valves disposed in the hydraulic circuit for controlling the flow of hydraulic fluid through the hydraulic circuit. A controller is configured to control one or more of the control valves as a function of a temperature of the hydraulic fluid. For example, the controller may be configured to receive an input related to a temperature of the hydraulic fluid and control at least one of the valves in view of said input. The input can be received e.g. from a sensor or based on calculation.

By controlling one or more valves as a function of temperature, the flow of hydraulic fluid may be activated or deactivated depending on the temperature. Undesired cooling of stagnant fluid may be prevented by activating or maintaining circulation through at least part of the hydraulic circuit depending on temperature. For example, circulation of the hydraulic fluid can be activated based on a condition that the temperature of the hydraulic fluid is below a predetermined minimum temperature. In this manner, the circulation of hydraulic fluid may in itself result in heating of the fluid, e.g. by friction and/or pump action. Accordingly, the system may maintain a temperature of the hydraulic fluid without any additional heating systems.

To determine the temperature of the hydraulic circuit, a temperature sensor may be provided. Accordingly, or more valves may be controlled as a function of the measured temperature. The temperature may also be derived in other ways, e.g. by knowledge of the pump power and efficiency, as well as volume, density, and specific heat of the fluid passing through the pump, a temperature increase can be calculated. Also the environmental temperature can be measured to derive the expected fluid temperature. In other embodiments of the present invention the oil temperature can be calculated beforehand, so the hydraulic system according to the present invention is configured to act for a predetermined heating time e.g., if none of the tools has been active for a determined inactivity period.

Alternatively, or in addition to the system maintaining hydraulic flow in cold conditions, the system may be configured to alleviate overheating. For example, the system may be configured to deactivate or prevent circulation of the hydraulic fluid through at least part of the hydraulic circuit based on a condition that the temperature of the hydraulic fluid is above a predetermined maximum temperature.

Preferably, a part of the hydraulic circuit is specifically configured to heat the hydraulic fluid by circulation through said part of the hydraulic circuit. For example, the hydraulic circuit comprises a flow restrictor configured to heat the hydraulic fluid by friction of the hydraulic fluid as it passes through the flow restrictor. Preferably a flow rate through the flow restrictor may be controlled as a function of the temperature. For example, a flow rate of the pump can be controlled as a function of the temperature. Alternatively, or in addition, the flow restrictor can have a controllable flow resistance. Accordingly, a flow resistance of the flow restrictor can be controlled as a function of the temperature.

In some embodiments, the flow restrictor has a relatively high flow resistance, e.g. higher than a part of the hydraulic circuit between the pump and a control valve leading up to the flow restrictor. For example, the flow restrictor has a flow resistance in relation to the pump allowing a flow through the flow restrictor of less than twenty liters per minute, preferably less than ten liters per minute, more preferably less than eight liters per minute. For example, the flow restrictor has a flow resistance in relation to the pump allowing a flow through the flow restrictor of more than one liter per minute, preferably more than two liters per minute, preferably more than five liters per minute, e.g. six liters per minute.

In some embodiments, the flow of hydraulic fluid through the flow restrictor does not cause actuating of any tools. For example the control valve being controlled as a function of a temperature controls a part of the hydraulic circuit separate from any of the actuated tools. Having a separate circuit, may have the advantage that the fluid can be kept circulating without undesired action by any of the tools. For example, one or more control valves may be controlled as a function of a temperature to control flow of hydraulic fluid through part of the hydraulic circuit separate from any hydraulic circuit through the actuated tools. For example, some control valves can be used for controlling a flow of hydraulic fluid for actuating the tools while other valves are controlled as a function of a temperature without actuating any tools. To prevent a deteriorated efficiency of the tools, the control valve to the flow restrictor may be closed while one or more control valves for operating the tools are open.

In other embodiment, a short-circuit path of hydraulic fluid partially traversing a path through one of the tools may be controlled as a function of temperature. For example, valves may be controlled for opening a short-circuit path of hydraulic fluid partially traversing through one of the tools when said one tool is not being actuated. In this way a circulation of fluid in the tool is maintained as much as possible while the short circuit path may prevent undesired actuating of the tool. The short-circuit path can be closed when it is desired to actuate the tool. For example, a tool comprises an actuating valve for actuating the tool by flowing hydraulic fluid through a regular actuating hydraulic circuit in the first tool and a short-circuit path with a separate control valve being controlled as a function of temperature. Accordingly, a flow of hydraulic fluid through at least part of the regular actuating circuit in the tool is maintained by opening the separate control valve when the tool is not being actuated. Optionally, the short-circuit path comprises a flow restrictor, e.g. mimicking a flow resistance that would be experienced through the regular path. In this way, the same friction and temperature increase can be maintained irrespective whether the tool is operated or not. Alternatively, the short-circuit path can have a relatively low resistance to save energy while still maintaining flow and preventing stagnant fluid.

To keep the amount of stagnant fluid as small as possible, it is preferred that a temperature control valve for maintaining a temperature of the hydraulic fluid is in proximity to an actuating control valve for actuating a tool. For example, the valve system comprises one or more flow control valves configured to maintain a flow of hydraulic fluid in at least fifty percent of the hydraulic circuit even when none of the tools are actuated, preferably at least eighty percent, more preferably at least ninety percent. By maintaining the flow of hydraulic fluid and preventing cooldown, it is not necessary to switch to low viscosity oils. Accordingly, the hydraulic fluid can have a normal or relatively high viscosity, e.g. higher than ISO22, preferably ISO Viscosity Grade 32 or higher.

Further aspects of the present disclosure may relate to a method of controlling a hydraulic system. During mechanical operation of one or more tools, the method may comprise hydraulically operating the tools via a hydraulic circuit by pressurizing a flow of hydraulic fluid via the hydraulic circuit to the tools while controlling the flow of hydraulic fluid by means of control valves disposed in the hydraulic circuit. During mechanical inactivity of the one or more tools, the method may comprise maintaining the flow of hydraulic fluid through at least part of the hydraulic circuit by controlling one or more control valves in the valve system as a function of a temperature of the hydraulic fluid.

It will be appreciated that some aspects of the present disclosure are particularly useful for a hydraulic system as part of an unmanned underwater vehicle (UUV) for deep water conditions where temperature can be low and external pressure can be high. Examples of unmanned underwater vehicles may include remotely operated vehicles (ROV), automatic underwater vehicles (AUV), crawlers, mining machines, etcetera. The disclosure may be used accordingly for controlling a remotely operated vehicle in deep water condition by controlling its hydraulic system according to the methods as described herein. For example, the hydraulic system is operated at an ambient temperature, e.g. water temperature, of less than five degrees Celsius, less than three degrees Celsius, or even less than zero degrees Celsius. For example, the hydraulic system is operated at a depth of at least five hundred meters, at least one kilometer or even more than three kilometers. For example, the hydraulic system is operated at an ambient pressure, e.g. water pressure, of at least five bar, at least ten bar, at least twenty bar, or even at least hundred bar.

BRIEF DESCRIPTION OF DRAWINGS

These and other features, aspects, and advantages of the apparatus, systems and methods of the present disclosure will become better understood from the following description, appended claims, and accompanying drawing wherein:

DESCRIPTION OF EMBODIMENTS

Figure 1:
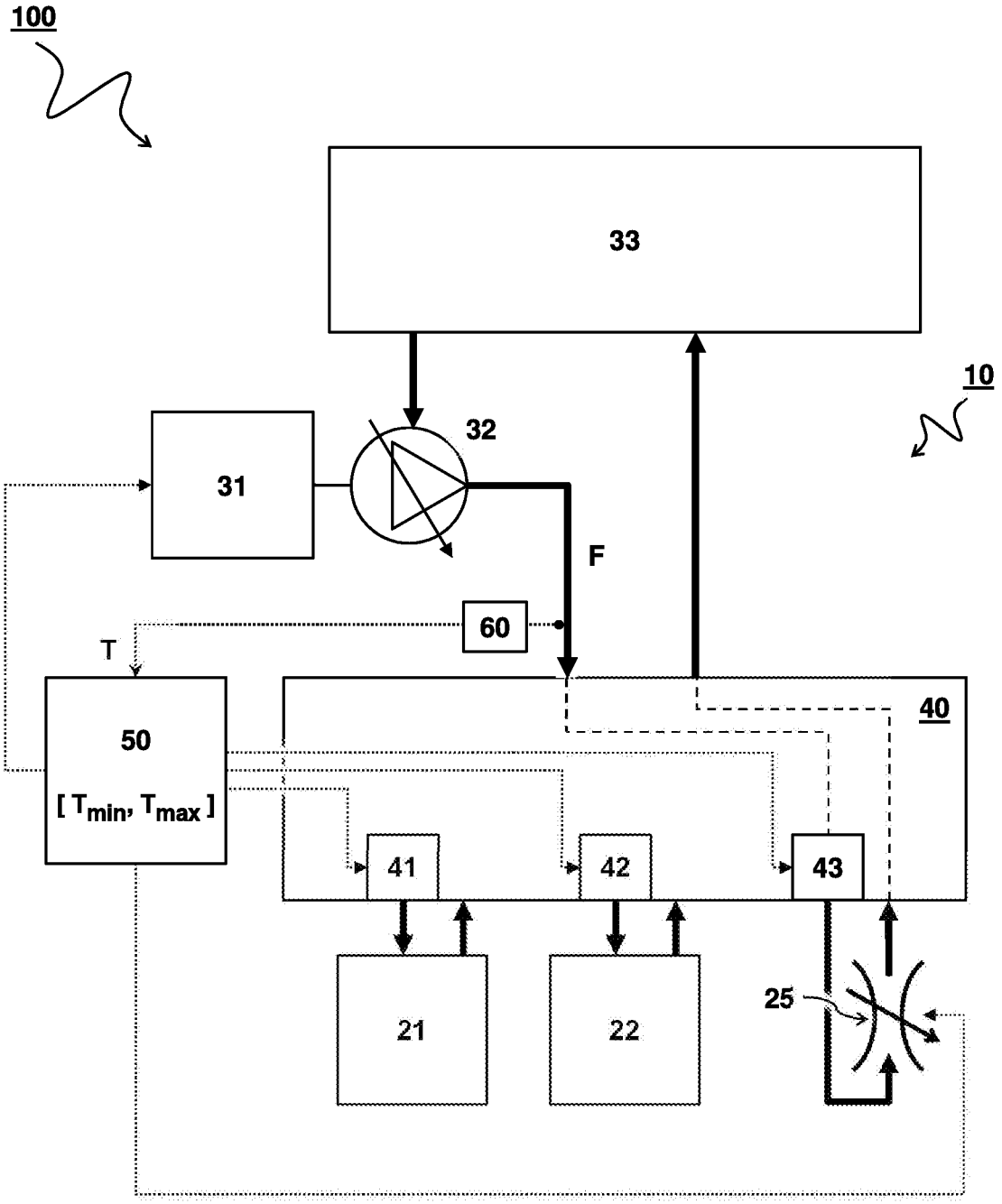
FIGS. 1 and 2 schematically show embodiments of a hydraulic system for use in cold surroundings.

In some instances, detailed descriptions of well-known devices and methods may be omitted so as not to obscure the description of the present systems and methods. Terminology used for describing particular embodiments is not intended to be limiting of the invention. As used herein, the singular forms "a", "an" and "the" are intended to include the plural forms as well, unless the context clearly indicates otherwise. The term "and/or" includes any and all combinations of one or more of the associated listed items. It will be understood that the terms "comprises" and/or "comprising" specify the presence of stated features but do not preclude the presence or addition of one or more other features. It will be further understood that when a particular step of a method is referred to as subsequent to another step, it can directly follow said other step or one or more intermediate steps may be carried out before carrying out the particular step, unless specified otherwise. Likewise it will be understood that when a connection between structures or components is described, this connection may be established directly or through intermediate structures or components unless specified otherwise.

In prior art ROVs, there may be no mechanism in place to keep the temperature of hydraulic fluid, e.g. oil, above ambient temperature and to keep oil moving within a circuit when it is not in use. In ultra-deep water conditions, this static oil can become cold and thick which may cause issues with electrical current spikes which can result in circuit breaker trips. This thick oil may also cause a restriction to flow and therefore the operating speed of a tool or function.

It has been noted that while working in very deep and cold water, the oil inside a hydraulic circuit may become very thick particularly while the circuit is idling (and the oil is not moving) to such a point that when a load is again applied on the hydraulic circuit a large spike of current is drawn which resulted in a circuit breaker tripping. The ambient temperature at some depth may even be slightly below zero degrees Celsius and the oil temperature during idling may fall as low as three to five degrees Celsius. The present systems may be installed to ensure that a certain minimum load is maintained and the hydraulic circuit itself is used to maintain heat in the oil. The result of this may be that the oil temperature is maintained to a minimum temperature of e.g. above twenty-five degrees Celsius. The oil can thus be prevented from thickening too much and oil may be continually circulated through the circuit ensuring that sudden application of load and therefore current spikes are avoided. By providing the option to turn on and off the present devices, it may be prevented that an unnecessary power is drained from the system. For example, the system may be turned on periodically and/or as function of temperature.

According to some embodiments, the disclosure provides a method to keep oil circulating within a hydraulic circuit to induce a temperature rise by using a controllable short circuit. For example, in one implementation, a small hydraulic circuit may be added to the circuit we want to control the temperature of and keep the oil moving, which can be switched on and off remotely. Once switched on the oil is pumped through a small adjustable orifice and then is plumbed back into the return line of the hydraulic circuit. The adjustment of the orifice correlates to a variation in the temperature being maintained in the circuit with the circuit remaining on to ensure that the main hydraulic circuit is constantly made to work.

In another implementation, a method is provided where warm oil is circulated around a tool using valves which can be switched on/off depending on the status of the tool. Switching on these valves artificially may create a short circuit path within a tool which would not be sufficient enough to drive the tool but would provide a path by which oil can circulate through. In order to limit the amount of static oil in a hydraulic circuit and therefore make the performance of the tool in terms of speed more predictable it is preferred to move valves so that they are located right at an actuator to eliminate dead oil.

The invention is described more fully hereinafter with reference to the accompanying drawings, in which embodiments of the invention are shown. In the drawings, the absolute and relative sizes of systems, and components may be exaggerated for clarity. Embodiments may be described with reference to schematic and/or cross-section illustrations of possibly idealized embodiments and intermediate structures of the invention. In the description and drawings, like numbers refer to like elements throughout. Relative terms as well as derivatives thereof should be construed to refer to the orientation as then described or as shown in the drawing under discussion. These relative terms are for convenience of description and do not require that the system be constructed or operated in a particular orientation unless stated otherwise.

Figure 2:
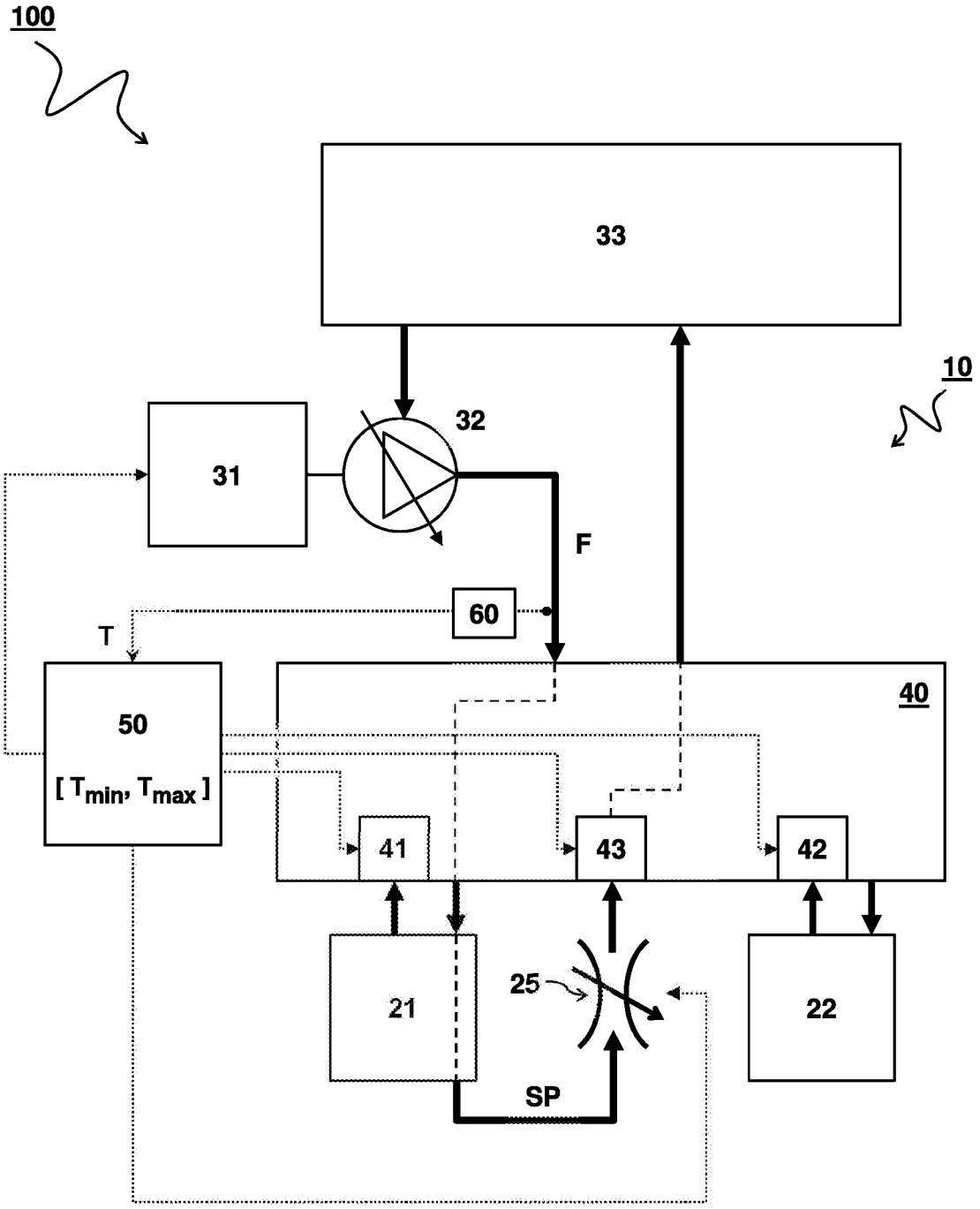

FIGS. 1 and 2 schematically show embodiments of a hydraulic system 100 for use in cold surroundings.

In one embodiment, the hydraulic system 100 comprises a hydraulic circuit 10. One or more tools 21,22 may be connected to the hydraulic circuit 10 for hydraulically operating the tools via the hydraulic circuit 10. A pump 32, e.g. pump, is configured to pressurize a flow of hydraulic fluid F via the hydraulic circuit 10 to the tools 21,22 for actuating the tools 21,22. A valve system 40 comprising control valves 41,42,43 may be disposed in the hydraulic circuit 10 for controlling the flow of hydraulic fluid F through the hydraulic circuit 10. Preferably, a controller 50 is configured to control one or more of the control valves 43 as a function of a temperature T of the hydraulic fluid F.

In one embodiment, the controller 50 is configured to receive an input related to a temperature T of the hydraulic fluid F and control at least one of the valves 43 in view of said input. Preferably, though not necessarily, the system comprises a temperature sensor 60 configured to measure a temperature T of the hydraulic fluid F and to control one or more of the control valves 41, 42, 43 as a function of the measured temperature T. Alternatively, or in addition to a sensor, the temperature T may be calculated or otherwise inferred.

In one embodiment, the controller 50 is configured to activate or maintain circulation of the hydraulic fluid F through at least part of the hydraulic circuit 10 based on a condition that the temperature T hydraulic fluid F is below a predetermined minimum temperature Tmin. In another or further embodiment, the system is be configured to prevent undesired cooling of the hydraulic fluid F by maintaining circulation of said hydraulic fluid F through at least part of the hydraulic circuit 10. Accordingly, at least part of the hydraulic circuit 10 is configured to heat the hydraulic fluid F by circulation through said part of the hydraulic circuit. Advantageously, the system is configured to maintain a temperature of the hydraulic fluid F without electrical heating. In another or further embodiment, the controller 50 is configured to deactivate or prevent circulation of the hydraulic fluid F through at least part of the hydraulic circuit 10 based on a condition that the temperature T hydraulic fluid F is above a predetermined maximum temperature Tmax. Accordingly, overheating may be prevented.

In one embodiment, the controller comprises a switch that is turned on or off based on a temperature sensor reading. The valve switch may also allow more than on/off positions, e.g. half-open. In another or further embodiment, the controller comprises circuitry with hardware and/or software instruction to automatically control a valve switch based on the temperature, e.g. sensor reading.

In some embodiments, the switching of one or more valves is based also on a pressure or depth measurement. For example, an ideal temperature of the hydraulic fluid may depend not only on the temperature but also on the pressure, which may affect viscosity. In one embodiment, the controller is configured to receive an input related to an ambient pressure or depth of the hydraulic system. In another or further embodiment, the controller is configured to control at least one of the valves (e.g. 43) in view of temperature input combined with pressure or depth input. For example, the hydraulic system 100 may comprise a pressure sensor (not shown) to measure ambient pressure or a depth sensor to measure a depth of the ROV. Alternatively, or in addition, also a pressure of the hydraulic fluid may be measured and the switching of one or more valves can be based thereon. In some embodiment, the system may comprise or communicate with a look-up table, graph, or function which calculates a desired target temperature based on a pressure measurement for achieving a predetermined viscosity threshold. This may then be achieved e.g. by opening one or more valves and letting the hydraulic fluid warm up at least until it reaches the target temperature, e.g. by friction.

In the shown embodiment, a first control valve 41 is used for controlling a flow of hydraulic fluid F through a first tool 21 for actuating the first tool 21. Furthermore, a second control valve 42 is used for controlling a flow of hydraulic fluid F through a second tool 22 for actuating the second tool 22. Finally, a third control valve 43 is controlled as a function of a temperature T preferably without actuating any tools 41,42. Accordingly, at least one of the control valves 43 being controlled as a function of a temperature T does not actuate any tools 41,42.

In one embodiment, the hydraulic circuit comprises a flow restrictor 25 configured to heat the hydraulic fluid F by friction of the hydraulic fluid F though the flow restrictor. For example, the controller is configured to control a flow rate though the flow restrictor as a function of the temperature T. For example, a flow resistance of the flow restrictor 25 may be adjusted by changing an aperture size. Alternatively, or in addition, the controller is configured to control a flow rate of the pump as a function of the temperature T. In some embodiments, the flow restrictor 25 has a controllable flow resistance, e.g. adjustable orifice. For example, the controller 50 is configured to control a flow resistance of the flow restrictor 25 as a function of the temperature T. Preferably, the flow of hydraulic fluid F through the flow restrictor 25 does not cause actuating of any tools 21,22. In other words, the flow restrictor may be a dedicated circuit with the purpose of heating the fluid by friction.

Preferably, the flow restrictor 25 provides a relatively high flow resistance. For example, the flow restrictor 25 has a flow resistance for the hydraulic fluid that is higher than a part of the hydraulic circuit 40 between the pump 32 and a control valve 43 leading up to the flow restrictor 25. Alternatively, or in addition, the flow restrictor 25 has a flow resistance in relation to the pump 32 allowing a flow through the flow restrictor 25 of less than twenty liters per minute, preferably less than ten liters per minute, more preferably less than eight liters per minute. Alternatively, or in addition, the flow restrictor 25 has a flow resistance in relation to the pump 32 allowing a flow through the flow restrictor 25 of more than one liter per minute, preferably more than two liters per minute, preferably more than five liters per minute, e.g. six liters per minute.

Typically, the controller 50 is configured to control the control valves 41,42 for controlling the tools 21,22. In the present embodiments, the controller 50 is further configured to close a control valve 43 to the flow restrictor 25 while one or more control valves 41,42 for operating the tools 21,22 are open.

In one embodiment, as shown in FIG. 1, at least one of the control valves 43 being controlled as a function of a temperature T controls a part of the hydraulic circuit separate from any of the actuated tools 41,42. For example, a control valves 43 being controlled as a function of a temperature T controls flow of hydraulic fluid F through part of the hydraulic circuit separate from any hydraulic circuit through the actuated tools 41,42.

In another or further embodiment, as shown in FIG. 2, at least one of the control valves 41, 42, 43 being controlled as a function of a temperature T controls a short-circuit path SP of hydraulic fluid at least partially traversing a hydraulic path through one of the tools 21. For example, the controller 50 is configured to control at least one of the control valves 43 as a function of a temperature T for opening a short-circuit path SP of hydraulic fluid partially traversing through one of the tools 21 when said one tool 21 is not being actuated. In some embodiments, the controller 50 is configured to control at least one of the control valves 43 as a function of a temperature T for closing a short-circuit path SP of hydraulic fluid partially traversing through one of the tools 21 when said one tool 21 is being actuated.

In the embodiment of FIG. 2, a first tool 21 comprises an actuating valve 41 for actuating the first tool 21 by flowing hydraulic fluid through a regular actuating hydraulic circuit in the first tool 21. Furthermore, the first tool 21 comprises the a short-circuit path SP with a separate control valve 43 being controlled as a function of temperature. Accordingly, a flow of hydraulic fluid through at least part of the regular actuating hydraulic circuit in the first tool 21 is maintained by opening the separate control valve 43 when said first tool 41 is not being actuated. In the shown embodiment, the short-circuit path SP comprises or couples to a flow restrictor 25. Alternatively, the flow restrictor is omitted from the short circuit path.

Preferably, a temperature control valve 43 for maintaining a temperature of the hydraulic fluid F is in proximity to an actuating control valve 41 for actuating a tool 21. For example, the valve system 40 comprises one or more flow control valves 43 configured to maintain a flow of hydraulic fluid in at least fifty percent of the hydraulic circuit 10 even when none of the tools 21,22 are actuated, preferably at least eighty percent, more preferably at least ninety percent. In one embodiment, the hydraulic fluid has a viscosity higher than ISO22, e.g. ISO Viscosity Grade 32 or higher. Preferably, the pump 32 is actuated by an electric motor 31. For example, the pump 32 is a constant pressure pump.

One method of controlling the hydraulic system 100 during mechanical operation of one or more tools 21,22 comprises hydraulically operating the tools 21,22 via a hydraulic circuit 10 by pressurizing a flow of hydraulic fluid F via the hydraulic circuit 10 to the tools 21,22 while controlling the flow of hydraulic fluid F by means of control valves 41,42 disposed in the hydraulic circuit 10. During mechanical inactivity of the one or more tools 21,22, the flow of hydraulic fluid F may be maintained through at least part of the hydraulic circuit 10 by controlling one or more control valves 43 in the valve system 40 as a function of a temperature T of the hydraulic fluid F.

For some applications, the system is configured for operating under water in deep-water conditions. For example, the hydraulic system 100 may be incorporated in an unmanned underwater vehicles such as a remotely operated vehicle (ROV) for deep water conditions. Alternatively or in addition to hydraulic tools, also other equipment can be used in the vehicle. For example an unmanned underwater vehicle for inspection may be equipped with a camera instead of, or in addition to one or more hydraulically operable tools. Some aspects of the present disclosure may thus be directed to an unmanned underwater vehicle with a hydraulic circuit as described herein, with or without hydraulic tools connected to the circuit.

In some aspects, the present systems and devices may be employed for a method of controlling a remotely operated vehicle in deep water condition by controlling its hydraulic system according to the methods as described herein. In some embodiments, the hydraulic system 100 is operated at an ambient temperature, e.g. water temperature, of less than five degrees Celsius, less than three degrees Celsius, less than zero degrees Celsius. In other or further embodiment, the hydraulic system 100 is operated at a depth of at least fifty meters, at least hundred meters, at least two hundred meters, at least five hundred meters, at least one kilometer. Alternatively, or in addition, the hydraulic system 100 is operated at an ambient pressure, e.g. water pressure, of at least five bar, at least ten bar, at least twenty bar, at least hundred bar.

For the purpose of clarity and a concise description, features are described herein as part of the same or separate embodiments, however, it will be appreciated that the scope of the invention may include embodiments having combinations of all or some of the features described. For example, while embodiments were shown for a specific hydraulic circuit with tools and a flow restrictor, also alternative ways may be envisaged by those skilled in the art having the benefit of the present disclosure for achieving a similar function and result. E.g. parts of the hydraulic system may be combined or split up into one or more alternative components. The various elements of the embodiments as discussed and shown offer certain advantages, such as preventing cooling of stagnant oil. Of course, it is to be appreciated that any one of the above embodiments or processes may be combined with one or more other embodiments or processes to provide even further improvements in finding and matching designs and advantages. It is appreciated that this disclosure offers particular advantages to the operation of hydraulic systems in deep water conditions, and in general can be applied for other cold surroundings.

Finally, the above-discussion is intended to be merely illustrative of the present systems and/or methods and should not be construed as limiting the appended claims to any particular embodiment or group of embodiments. The specification and drawings are accordingly to be regarded in an illustrative manner and are not intended to limit the scope of the appended claims. In interpreting the appended claims, it should be understood that the word "comprising" does not exclude the presence of other elements or acts than those listed in a given claim; the word "a" or "an" preceding an element does not exclude the presence of a plurality of such elements; any reference signs in the claims do not limit their scope; several "means" may be represented by the same or different item(s) or implemented structure or function; any of the disclosed devices or portions thereof may be combined together or separated into further portions unless specifically stated otherwise. The mere fact that certain measures are recited in mutually different claims does not indicate that a combination of these measures cannot be used to advantage. In particular, all working combinations of the claims are considered inherently disclosed.

The invention claimed is:

1. An unmanned underwater vehicle for use in cold surroundings, the unmanned underwater vehicle comprising:

a hydraulic system comprising:

a hydraulic circuit;

a pump configured to pressurize a flow of hydraulic fluid via the hydraulic circuit;

a valve system comprising control valves disposed in the hydraulic circuit for controlling the flow of hydraulic fluid through the hydraulic circuit; and a controller configured to control a temperature of the hydraulic fluid by controlling at least one of the valves in view of a temperature input related to the temperature of the hydraulic fluid.

2. The unmanned underwater vehicle according to claim 1, wherein the controller is configured to activate or maintain circulation of the hydraulic fluid through at least part of the hydraulic circuit based on a condition that the temperature of the hydraulic fluid is below a predetermined minimum temperature.

3. The unmanned underwater vehicle according to claim 1, is further configured to prevent cooling of the hydraulic fluid by maintaining circulation of the hydraulic fluid through at least part of the hydraulic circuit in absence of actuating any tools.

4. The unmanned underwater vehicle according to claim 1, wherein the hydraulic system is configured to maintain the temperature of the hydraulic fluid without electrical heating.

5. The unmanned underwater vehicle according to claim 1, wherein the hydraulic circuit comprises a flow restrictor.

6. The unmanned underwater vehicle according to claim 5, wherein the flow restrictor is configured to heat the hydraulic fluid by friction of the hydraulic fluid though the flow restrictor, and wherein the controller is configured to control a flow rate though the flow restrictor as a function of the temperature.

7. The unmanned underwater vehicle according to claim 6, wherein the flow restrictor has a controllable flow resistance, and wherein the controller is configured to control a flow resistance of the flow restrictor as a function of the temperature.

8. The unmanned underwater vehicle according to claim 1, wherein the controller is further configured to receive an input related to a pressure of the hydraulic fluid and/or a depth of the hydraulic system, and control at least one of the control valves in view of the input combined with the pressure or depth input.

9. The unmanned underwater vehicle according to claim 1, wherein the controller is configured to control the control valves for controlling one or more tools through the hydraulic circuit, and wherein the controller is configured to close at least one control valve of the control valves to a flow restrictor while the control valves for operating the tools are open.

10. The unmanned underwater vehicle according to claim 1, comprising a temperature sensor configured to measure a temperature of the hydraulic fluid and to control one or more of the control valves as a function of the measured temperature.

11. The unmanned underwater vehicle according to claim 1, wherein at least one of the control valves being controlled as a function of a temperature controls a short-circuit path of hydraulic fluid partially traversing a hydraulic path through one or more tools, and wherein the controller is configured to control at least one of the control valves as a function of a temperature for opening the short-circuit path when the one or more tools is not being actuated and closing the short-circuit path when the one or more tools is being actuated.

12. The unmanned underwater vehicle according to claim 1, wherein the control valves are configured to maintain a flow of hydraulic fluid in at least ninety percent of the hydraulic circuit even when no tools are actuated.

13. A method of controlling a hydraulic system within an unmanned underwater vehicle in cold surroundings, the method comprising:

during mechanical operation of one or more tools, hydraulically operating the one or more tools via a hydraulic circuit by pressurizing a flow of hydraulic fluid via the hydraulic circuit to the one or more tools while controlling the flow of hydraulic fluid of control valves disposed in the hydraulic circuit; and during mechanical inactivity of the one or more tools, controlling a temperature of the hydraulic fluid by maintaining the flow of hydraulic fluid through at least part of the hydraulic circuit by controlling the control valves in the valve system in view of a temperature input related to the temperature of the hydraulic fluid.

14. The method according to claim 13, wherein the unmanned underwater vehicle operates in deep water conditions.

15. The method of claim 13, wherein the vehicle is operated at a water temperature of less than five degrees Celsius and at a depth of at least five hundred meters.

16. The method of claim 13, further comprising:

preventing cooling of the hydraulic fluid by maintaining circulation of the hydraulic fluid through at least part of the hydraulic circuit in absence of actuating any tools.

17. The method of claim 13, wherein the temperature of the hydraulic fluid is maintained without electrical heating.

18. The method of claim 13, further comprising:

heating the hydraulic fluid by friction of the hydraulic fluid though a flow restrictor, wherein the controller is configured to control a flow rate though the flow restrictor as a function of the temperature.

19. The unmanned underwater vehicle according to claim 18, further comprising:

controlling a flow resistance of the flow restrictor as a function of the temperature.

20. The method of claim 13, further comprising:

measuring, via a temperature sensor, a temperature of the hydraulic fluid; and controlling one or more of the control valves as a function of the measured temperature.

* * * * *